US007462108B2

(12) United States Patent
O'Mahony

(10) Patent No.: US 7,462,108 B2
(45) Date of Patent: Dec. 9, 2008

(54) GOLF SWING PRACTICE SIMULATOR

(76) Inventor: Noel O'Mahony, 20 Patterson Rise SW., Calgary, Alberta (CA) T3H 2E4

( * ) Notice: Subject to any disclaimer, the term of this patent is extended or adjusted under 35 U.S.C. 154(b) by 338 days.

(21) Appl. No.: 11/457,799

(22) Filed: Jul. 15, 2006

(65) Prior Publication Data

US 2006/0270483 A1 Nov. 30, 2006

(51) Int. Cl.
*A63B 69/36* (2006.01)

(52) U.S. Cl. ..... 473/139; 473/140; 473/141; 473/149

(58) Field of Classification Search ..... 473/137, 473/138, 139–142, 143–150, 151–156, 157
See application file for complete search history.

(56) References Cited

U.S. PATENT DOCUMENTS

| | | | |
|---|---|---|---|
| 1,213,679 | A | 1/1917 | Murphy |
| 1,419,636 | A | 6/1922 | Macdonald |
| 1,680,897 | A | 8/1928 | Matheson, Jr. |
| 1,932,049 | A | 10/1933 | Ryan |
| 1,991,252 | A | 2/1935 | Kane |
| 2,018,291 | A | 10/1935 | Thompson |
| 2,834,210 | A | 5/1958 | Edward |
| 3,535,936 | A | 10/1970 | Howell |
| 3,870,314 | A | 3/1975 | Bertucci |
| 4,084,822 | A | 4/1978 | Keeton |
| 4,085,935 | A | 4/1978 | Mason |
| 4,624,461 | A | 11/1986 | Way |
| 4,717,153 | A | 1/1988 | Breen |
| 4,767,121 | A | 8/1988 | Tonner |
| 4,949,973 | A | 8/1990 | Williamson |
| 4,958,836 | A | 9/1990 | Onozuka et al. |
| 5,269,519 | A | 12/1993 | Malone |
| 5,390,930 | A | 2/1995 | Hu et al. |
| 5,451,059 | A | 9/1995 | Weis |
| 5,499,812 | A | 3/1996 | Staka et al. |
| 5,700,203 | A | 12/1997 | Shieh |
| 5,863,255 | A | 1/1999 | Bair et al. |
| 6,106,406 | A | 8/2000 | Jouan |
| 6,129,637 | A | 10/2000 | Wang et al. |
| 6,146,283 | A | 11/2000 | Ferguson |
| 6,254,491 | B1 | 7/2001 | Chou |

(Continued)

*Primary Examiner*—Nini Legesse
(74) *Attorney, Agent, or Firm*—Bay Area Patent Group, LLC

(57) ABSTRACT

A practice golf swing device which permits the swinger of a golf club to hit a variable height replica golf ball that is fixedly attached to a universally pivoting arm (swivel arm) that moves in direct proportion to the swing path and speed of the golf club. The motion thus initiated in the swivel arm may be measured at the base of the arm (knuckle ball) using an optical/digital sensing output as disclosed in U.S. Pat. Nos. 5,288,993 and 5,703,356 with this measurement being computed so as to numerically or graphically depict the movement. This graphical depiction may be viewed as a pictorial view of a golf ball in flight along the path that would be expected had the ball been struck by a golf ball with the same force and direction that is imparted to the replica golf ball, which is attached to the pivot arm of the device. The apparatus has a self-zeroing capability that provides an identical "at rest" position prior to impact. Thus, the only force that can affect the measured movement of the arm and the replica golf ball is the force applied directly to the ball at the point in time of impact.

15 Claims, 5 Drawing Sheets

U.S. PATENT DOCUMENTS 6,257,989 B1 7/2001 Tortola et al.
6,554,716 B1 4/2003 Loh et al.
6,767,282 B2 7/2004 Matsuyama et al.
6,778,915 B2 8/2004 Kelly et al.
6,887,162 B2 5/2005 Lindsay
2001/0009870 A1 7/2001 Hammerquist FIG. 4
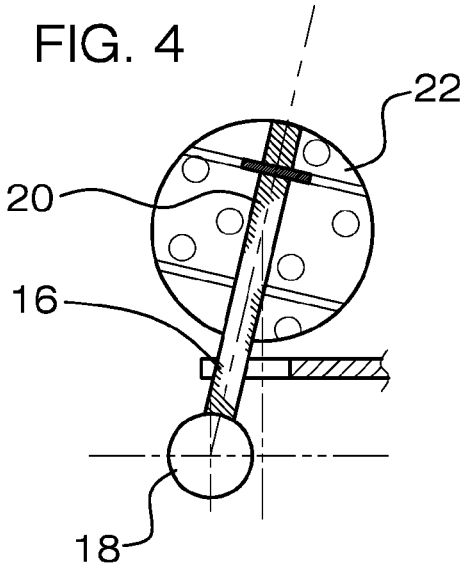
FIG. 5
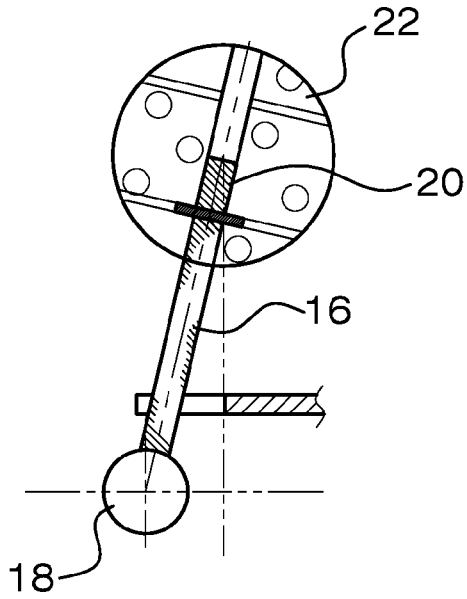
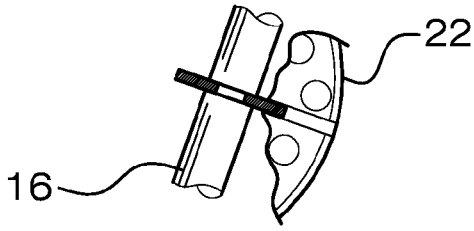
FIG. 6

GOLF SWING PRACTICE SIMULATOR

CROSS-REFERENCE TO RELATED APPLICATIONS

This application claims the benefit of U.S. application Ser. No. 10/454,279, filed Jun. 3, 2003 now abandoned, the entire of which is incorporated herein by reference.

INCORPORATION BY REFERENCE

Applicant(s) hereby incorporate herein by reference, any and all U.S. patents, US patent applications, and other documents and printed matter cited or referred to in this application.

BACKGROUND OF THE INVENTION

1. Field of the Invention

This invention relates generally to practice equipment in the filed of golf and more particularly to measuring, predicting and simulating golf ball trajectory and force of impact in a simple stationary equipment.

2. Description of Related Art

The following art defines the present state of this field:

Kinrot et al. U.S. Pat. No. 6,424,407, defines a method for determining the relative motion of a surface with respect to a measurement device comprising: illuminating the surface with incident illumination; detecting illumination reflected from the surface to form at least one detected signal; and determining the amount of relative motion parallel to the surface from said at least one detected signal, characterized in that said determining includes correcting for the effects of relative motion perpendicular to the surface.

Tonner U.S. Pat. No. 4,767,121: A golf simulating apparatus capable of simulating play on a golf course and/or a driving range. A pivotally mounted resilient ball member (38) is arranged to be impacted with the head of a golf club as the club is swung by the player. Special sensors are associated with the ball member (38) to sense its velocity and any lateral deviation from a fixed plane of movement (Y-Y) thereby to provide signals representing a probable distance and direction of ball travel. These signals are applied to the input ports of a computer (80) which is programmed to provide output signals to a monitor (20) so that it displays a simulated golf course or driving range, with the simulated path of ball travel and/or landing position being displayed on the golf course or driving range. The program provides the golf course or driving range with selected hazards (water, sand, trees etc.). Provision is made for counting and displaying the number of strokes, for averaging distances, assessing penalties and the like thereby to provide a simulation of conditions likely to be encountered during actual play of a game of golf.

Chen, et al. U.S. Pat. No. 4,429,880: A game simulator device permits the golf player to view a specific golf course or portion thereof on a television monitor and is provided with additional information relating to the lie of ball and its position in relation to the hole. The golfer then hits the ball in the normal manner, which ball is fixedly retained on a joystick apparatus, whereby in striking the ball the joystick transmits signals to a computer which generates graphic data relative to a golf course and converts the signal input to graphic display information relative to the new position or lie of the ball in relation to the hole on the golf course. The golf ball is mounted so that when struck, first and second signals for each of four degrees of movement are transmitted to the computer and correlated with the golf course data input. The device in one embodiment utilizes a video disc whereby the course layout is pictorially viewed on a television monitor in addition to graphic information, and the computer determines the pictorial scene to be displayed depending upon the location of the golf ball after being struck by the golfer. The device is useful to simulate other ball games, such as billiards, pool or croquet.

Onozuka, et al. U.S. Pat. No. 4,958,836: In a golf simulator having a housing in which a display and a reproducing device are accommodated, and an arm to the distal end of which a ball is secured, the golf simulator comprises a bed plate which supports a horizontal shaft; a swingable bed rotatable on the horizontal shaft and having another shaft which makes a right angle with the horizontal shaft, and to which the proximal end of the arm is rotatably secured; and drive means for driving the swingable bed so as to enable the shaft of the swingable bed to be selectively in either of a first state in which the shaft inclines with respect to the vertical line and toward approaching to the front side of the housing, and a second state in which the shaft inclines with respect to the vertical line and in the reverse of inclination under the first state.

Teitell, et al. U.S. Pat. No. 5,826,874: The golf game system of the present invention includes at least two magnetic induction coil sensors to simulate the speed and the direction of a golf swing by a golfer. A magnetic strip adhesively attached to the end of the golf club locates the position of the golf club with respect to the sensors. An electronic circuitry panel translates the information provided by the magnetic induction coil sensors into information that is acceptable to the customized software package. The magnetic sensing system interfaces with standard software packages for a personal computer to allow a user to swing a real golf club and have the results entered and displayed by the software package. In one preferred embodiment of the invention, the magnetic sensing system and electronic circuitry panel interfacing with the personal computer are integrated into a golf mat. The magnetic induction coil sensors may be flat induction coils built into the mat to minimize mat thickness. The golf mat further may include means to select functions such as the number of the golf club from the software package without returning to the mouse of the personal computer. The selection means may be realized with a 'magnetic mouse' integrated into the golf mat so that the golfer may position the cursor on the computer screen by moving the golf club around an area of the golf mat. Magnetic sensors in the golf mat interact with the magnet on the end of the golf club to position of the cursor over the desired function from the software package, and the golfer may then click on that function with a switch or button on the golf mat.

Teitell, et al. U.S. Pat. No. 5,728,006: The golf game system of the present invention includes a pair of magnetic induction coil sensors to simulate the speed and, optionally, the direction of a golf swing by a golfer. The magnetic sensing system interfaces with standard software packages for a personal computer to allow a user to swing a real golf club and have the results entered and displayed by the software package. The golf game system of the present invention is useful for its recreational and entertainment value, permitting the user to practice his golf swing, and possibly for golf training and teaching applications. A magnetic strip adhesively attached to the end of the golf club locates the position of the golf club with respect to the sensors, without the need for optical sensing. An electronic circuitry panel translates the information provided by the magnetic induction coil sensors into information that is acceptable to the customized software package.

Mueller U.S. Pat. No. 4,202,547 A movable golf green is disclosed which is movable along a predetermined track and the golf green is rotatable to provide a multitude of golf green simulation layouts and changing pin positions to the user of the apparatus.

Curchod U.S. Pat. No. 5,226,660 A golf simulating apparatus having a driving simulator and an actual green area adjacent thereto for simulating a complete game of golf, comprising apparatus for generating signals indicative of the velocity, trajectory and spin of a hit golf ball. A computer apparatus connected to the generating apparatus is provided for receipt of the signals and for processing the signals to determine the distance and location of the hit golf ball would have travelled on a golf course, the computer apparatus calculating the lie of the ball on a simulated hole. Also, display apparatus controlled by the computer apparatus is provided for projecting the simulated hole of golf so that as a golfer moves down the fairway the view of the hole from the golfers vantage point is displayed.

Richards U.S. Pat. No. 5,711,717: An apparatus for guiding a simulated golf swing consists of a golf club handle fixed at one end of a mechanical linkage whose other end can be fixed to a wall. The handle is fixed, so as to be rotatable about its own axis, to a crank of the linkage. The crank is connected in turn to an elongate arm pivoted at the fixing location so as to guide a swing in a basic arc. A central pivot of the crank permits the user's wrists to flex during the swing. The handle carries a projecting pointer which moves over an index plate fixed to the adjacent connector on the crank. The index plate has stop lugs to limit the rotation of the handle by abutting the turning pointer. A scale on the index plate enables a suitable address position to be selected. By thus controlling and indicating the handle's rotation it becomes possible to school the user's hand movements and thereby improve the alignment of the club face during the swing.

The prior art teaches various golf swing training devices as shown by the above descriptions, but does not teach a golf swing device enabled for measuring force and trajectory in a simple light reflecting device. The present invention fulfills these needs and provides further related advantages as described in the following summary.

SUMMARY OF THE INVENTION

The present invention teaches certain benefits in construction and use which give rise to the objectives described below.

The present invention utilizes a motion processing unit (MPU) that operates on the principle of displacement of position sensing. Various sensing approaches may be used.

In the preferred approach, rotation of a swivel-arm having attached at an upper end a replica golf ball will cause movement in a ball in a socket at its lower end.

Movement is sensed optically. Light from a light emitting diode circuit is bounced off the measured ball's surface to a semiconductor light sensor circuit and forms a received signal. This signal is processed by a digital processor circuit which delivers a digital signal to a computer circuit that is used as an integral part of a computer program that can generate a numerical display of speed and direction or a graphical simulation of the same data (i.e., simulated ball flight). The measured (knuckle) ball is mounted rotatably within a socket with the socket mounted fixedly to the body of the device and a motion detecting optical system is positioned at a fixed distance from the knuckle ball. The knuckle ball is held in place but allowed to rotate as previously described and shown on the drawings supplied. When the replica golf ball is struck by a club, the motion processing unit (MPU) produces a signal output proportional to rotational movement of the knuckle ball.

The motion processing unit (MPU) consists of an optical sensing unit, located in close proximity behind the knuckle ball (see drawings). This is used to create a digital signal that will be used to compute the movement (velocity) of the replica golf ball. The preferred embodiment used will be similar to the technology invented by Agilent Technologies, that being a light—emitting diode (LED) that will bounce light off of the knuckle ball and be received by a complimentary metal oxide semiconductor sensor. This signal is then sent to a digital signal processor (DSP) that is able to detect patterns in the sequenced images and how they have changed and can thereby determine how far the image has moved. The corresponding coordinates are sent to the computer which mirrors the movement. This technology exists and is used in optical mouse technology (see patents U.S. Pat. Nos. 5,288,993 and 5,703,356, as well as others).

This signal output alone is sufficient to actually proportionately represent the movement of the knuckle ball on the computer screen. The data with respect to movement of the knuckle ball is sent from the DSP to the computer serially on the data line which is based on the number of bits per second, thereby allowing the computation of the speed and direction of the ball by measuring the time elapsed during the deviation from any fixed position, for example, the zero position to any other position, i.e. the finished position with respect to both the "X" and "Y" axes.

A primary objective of the present invention is to provide a simple apparatus and method of use of such apparatus that provides advantages not taught by the prior art.

Another objective is to provide such an invention capable of measuring the motion of a replica golf ball device and producing a numerical representation of speed and direction of the replicated ball.

Another objective is to provide such an invention capable of measuring the motion of a simulated golf ball device and projecting such motion visually as to potential line of flight on a computer or T.V. screen.

A further objective is to provide such an invention capable of using only one sensing device to measure and project such motion.

A still further objective is to provide such an invention capable of detecting a "slice" or "hook" in the motion of a replica golf ball (i.e., motion relative to the sphere itself).

A still further objective is to measure the force applied to a golf ball when struck by a club.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings:

FIG. 4 is a sectional view of the apparatus with the replica golf ball in the lower position (for putting and other non driver type strokes);

FIG. 5 is a sectional view of the apparatus showing the replica golf ball in the elevated or "driver" position;

FIG. 6 is a cut away sectional view of the detail regarding the means of attachment of the replica golf ball to the swivel arm.

DETAILED DESCRIPTION OF THE PREFERRED EMBODIMENTS

Figure 1:
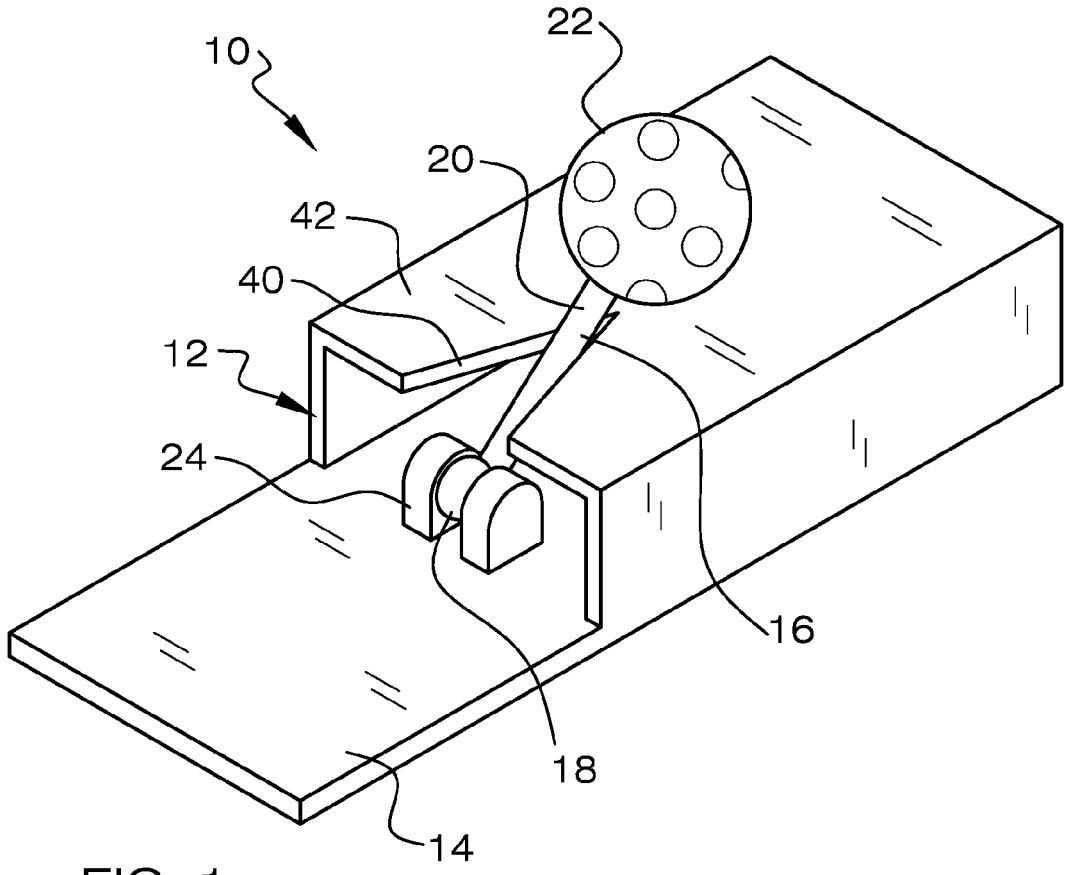
FIG. 1 is a schematic diagram (oblique view) of the preferred embodiment of the invention.

Referring to FIGS. 1-7, there is shown diagrammatically, a swing practice device 10 constructed in accordance with the present invention. The swing practice device 10 includes a moulded plastic housing 12 and a base platform 14.

The swing practice device 10 includes a rigid swivel arm 16 having a ball shaped lower end 18 and an upper end 20 to which a replica golf ball 22 is attached. The ball shaped lower end 18 is rotatably captured by a socket 4 24, which forms an integral part of the housing. In, the preferred embodiment, the ball shaped end 18 is received by the socket 24 in a "snap-fit" method of attachment, which relies upon the application of a sufficient frictional force to retain the position of ball shaped end while allowing rotational movement thereof. In yet a further embodiment a spring loading of the sides of the socket-4 24 could be provided.

The replica golf ball 22 is attached to the upper end 20 of the swivel arm 16 such that the replica golf ball is positionable at two distinct heights or elevations relative to the housing 12. The replica golf ball 22 being positionable at two different elevations accommodates iron shots and putting strokes of the golf club that require a lower position of a golf ball as well as wood shots that require a higher position. The replica golf ball 22 is fixedly attached to the swivel arm 16 at two different elevations relative to the housing 12 in such a fashion that the replica golf ball can be pulled upwards from the swivel arm, turned 180 degrees and placed back upon the swivel arm in such a fashion that the swivel arm is inserted into the replica golf ball, the result being the replica golf ball is frictionally attached at a position that is higher or lower than the immediate prior position of the replica golf ball.

Figure 2:
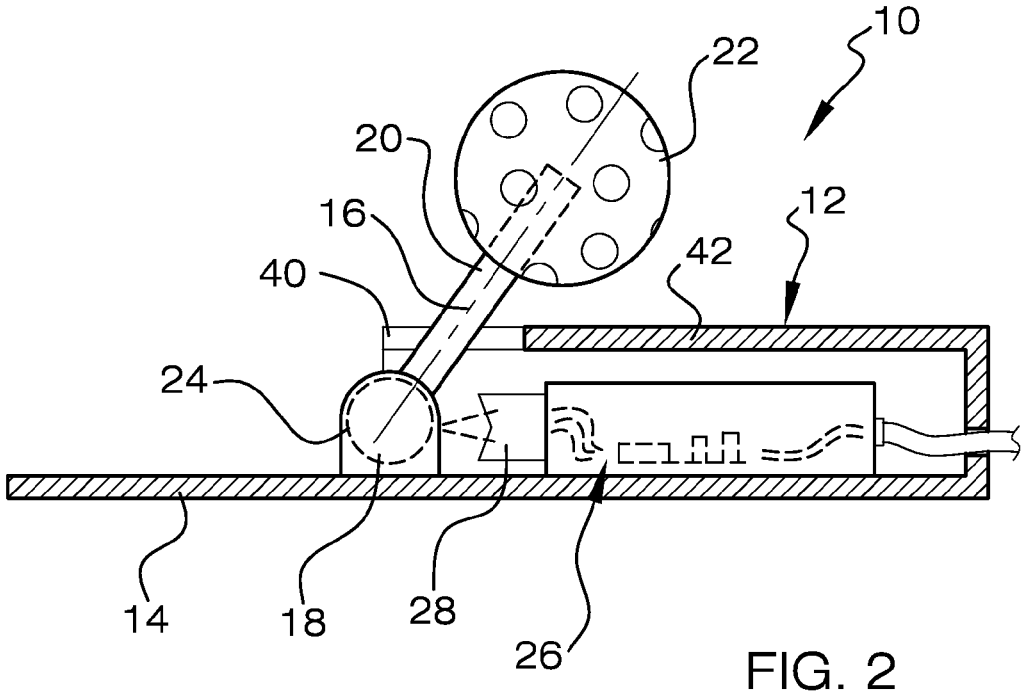
FIG. 2 is a sectional view of the apparatus.
Figure 3:
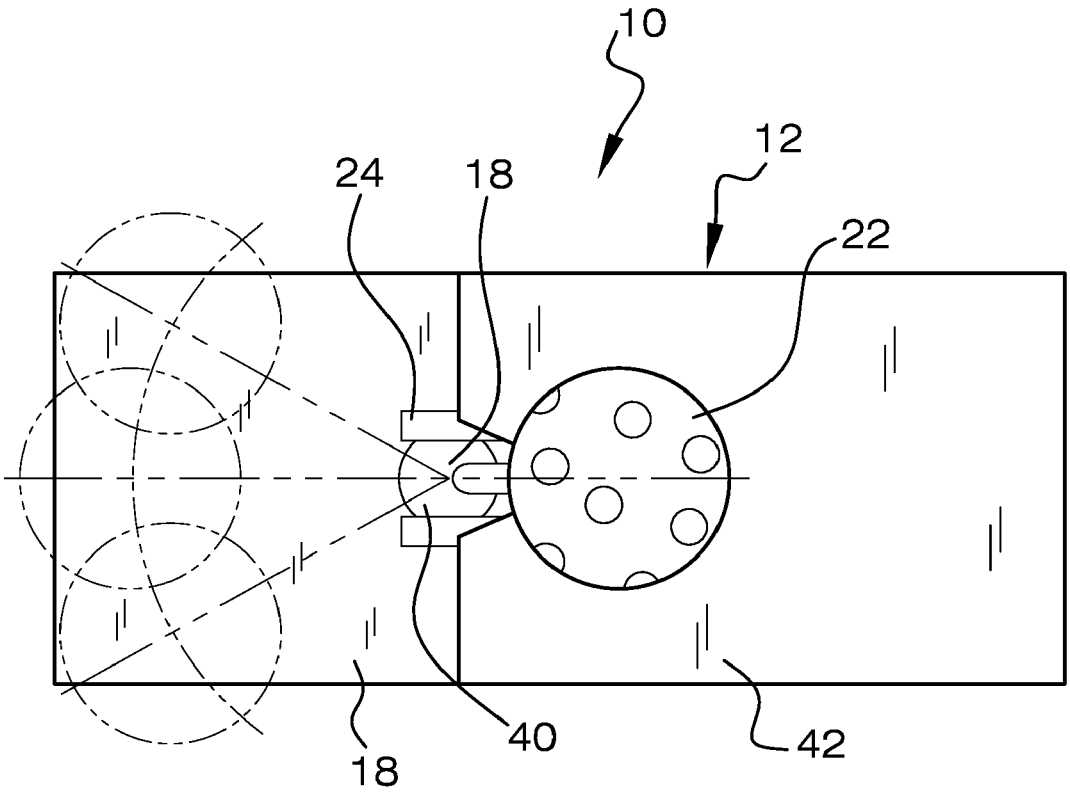
FIG. 3 is a planned view of the apparatus.
Figure 7:
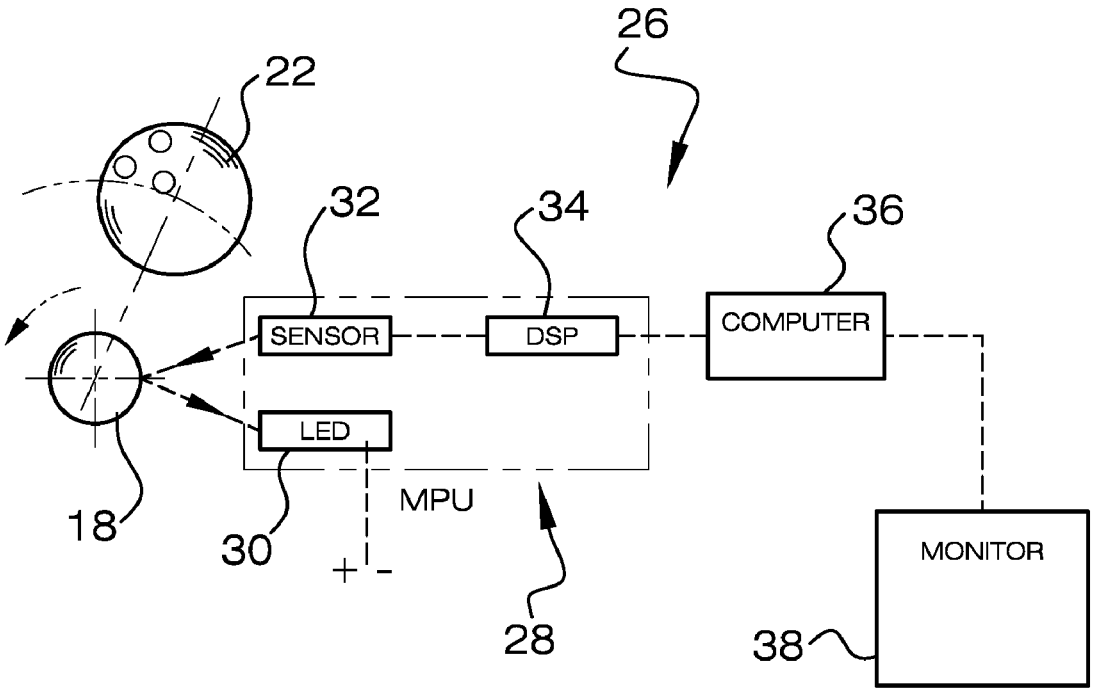
FIG. 7 is a block diagram showing the inter relationship between the replica golf ball, the swivel arm, the knuckle ball, the light emitting dial (LED), the sensor, the digital signal processor, the computer and the monitor of the apparatus.

With particular references to FIGS. 2 and 3, the replica golf ball 22 being secured to the upper end 20 of the rigid swing arm 16 and the lower ball shaped end 18 being captured by the socket 24 allows the replica golf ball, swing arm, and ball shaped end to all move in unity, such as for example when the replica golf ball is stuck by a golf club (not shown). The replica golf ball 22 may move along a line of symmetry, indicate by reference numeral A, or may move to either side of the line of symmetry as shown.

The swing practice device 10 further includes a motion-processing unit 26 positioned at a fixed distance from the lower ball shaped end 18. The motion-processing unit 26 includes an optical sensing unit 28 located in close proximity to the ball shaped end 18 and reward of the socket 24, a digital processor circuit 36, and a display monitor 38. The optical sensing unit 28 functions to create a digital signal that is used to compute the movement (velocity) of the replica golf ball 22. The optical sensing unit 28 includes a light source 30, preferably a light emitting diode (LED) a semiconductor light sensor 32, preferably, a metal oxide semiconductor and a digital signal processor (DSP) 34 connected to the light sensor. In combination, the light source 30 directs light at the ball shaped end 18, the light sensor 32 receives reflected light from the ball shaped end and the DSP creates a digital signal output proportional to the rotational movement of the ball shaped end as described in U.S. Pat. No. 6,424,407 to Kinrot et., which is incorporated by reference herein. In the preferred embodiment, the ball shaped end 18 is finished to a roughness grade that is conducive to the reflection of light from the light source 30.

The digital processor circuit 36, typically a computer, is connected with the optical sensing unit 28 for receiving the digital signal output and for calculating the trajectory and force impact of a golf club hitting the replica golf ball 22 from the information carried by the digital signal. The rotational movement of the ball shaped end 18 is used to calculate an estimate of trajectory curvature while the rate of the rotation provides an estimate of contact force, such calculations are well known in the art. A display monitor 38 is interconnected to the digital processor circuit 36 and operates to provide a visual display of the estimated trajectory to a user.

Additionally, the housing 12 can include a V-shaped notch 40 for receiving and cradling the swivel arm 16 as best shown in FIGS. 1 and 2. The V-shaped notch 40 provides for self-centering and identical "primed" position of the swivel arm prior to each impact. Preferably, the V-shaped notch 40 is flared so as to accommodate a ten-degree angle of rest or repose with respect to the vertical. This is to accommodate the self-zeroing/self-centering aspect of the swing practice device 10 and also to accommodate true movement of the swivel arm 16 when struck. The digital processor circuit 36, is capable of processing the digital signal created by the optical sensing unit 28 to detect when the swivel arm 16 is positioned in the V-shaped notch 40 and will automatically reset the program to "prime" or "zero" position before the user strikes the replica golf ball 22.

In the preferred embodiment, the notch 40 is positioned at, or below, a surface level upon which a golfer stands to interface with the invention so that only the replica golf ball 22 is above such surface. Further, enclosure 42 protects the various components of the invention from damage by the golf club.

While the invention has been described with reference to at least on preferred embodiment, it is to be clearly understood by those skilled in the art that the invention is not limited thereto, and the scope of the invention is to be interpreted only in conjunction with the appended claims.

What is claimed is:

1. A golf swing practice simulator device comprising:

a replica golf ball;

a swivel arm having an upper end and a lower ball shaped end, said replica golf ball being attached to said upper end;

a socket, said socket rotatably receiving said lower ball shaped end;

a housing, said socket attached to said housing;

a motion processing unit positioned at a fixed distance to said lower ball shaped end, said motion processing unit comprising:

an optical sensing unit for detecting rotational movement of said lower ball shaped end and generating a digital signal output proportional to the detected rotational movement of said lower ball shaped end;

a digital processor circuit connected with said optical sensing unit for receiving said digital signal output and for calculating the trajectory and force impact of a golf club hitting said replica golf ball; and a display monitor connected to said digital processor circuit for providing a visual display of the trajectory to a user.

2. The golf swing practice simulator device of claim 1, wherein said swivel arm is rigid.

3. The golf swing practice simulator device of claim 2, wherein said housing defines a V-shaped notched for receiving and cradling said swivel arm.

4. The golf swing practice simulator device of claim 3, wherein said V-shaped notched is flared at an angle often degrees to the vertical.

5. The golf swing practice simulator device of claim 2, wherein said replica golf ball is capable of being attached to said swivel arm at two different elevations.

6. The golf swing practice simulator device of claim 5, wherein said replica golf ball is capable of being attached to said swivel arm at two different elevations in such a fashion that said replica golf ball can be pulled upwards from said swivel arm, turned 180 degrees and replaced upon the swivel arm in such a fashion that said swivel arm is inserted into said replica golf ball, the result being said replica golf ball being attached at a position which is higher or lower than the position of said replica golf ball immediately prior to removal of said replica golf ball from said swivel arm.

7. The golf swing practice simulator device of claim 1 wherein said lower ball shaped end is finished to a roughness grade that is conducive to the reflection of light.

8. A golf swing practice simulator device comprising:

a replica golf ball;

a rigid swivel arm having an upper end and a lower ball shaped end, said replica golf being attached to said upper end;

a socket, said socket rotatably receiving said lower ball shaped end;

a housing, said socket attached to said housing;

a motion processing unit positioned at a fixed distance to said lower ball shaped end, said motion processing unit comprising:

an optical sensing unit for detecting rotational movement of said lower ball shaped end and generating a digital signal output proportional to the detected rotational movement of said lower ball shaped end;

a digital processor circuit connected with said optical sensing unit for receiving said digital signal output and for calculating the trajectory and force impact of a golf club hitting said replica golf ball;

a display monitor connected to said digital processor circuit for providing a visual display of the trajectory to a user;

said optical sensing unit comprising:

a light source, said light source directing light at said lower ball shaped end;

a semiconductor light sensor for sensing reflected light from said light source; and a digital signal processor connected to said semiconductor light sensor for generating said digital signal output.

9. The golf swing practice simulator device of claim 8, wherein said lower ball shaped end is finished to a roughness grade that is conducive to the reflection of light.

10. The golf swing practice simulator device of claim 8, wherein said housing defines a V-shaped notched for receiving and cradling said swivel arm.

11. The golf swing practice simulator device of claim 10, wherein said V-shaped notched is flared at an angle often degrees to the vertical.

12. The golf swing practice simulator device of claim 8, wherein said replica golf ball is capable of being attached to said swivel arm at two different elevations.

13. The golf swing practice simulator device of claim 12, wherein said replica golf ball is capable of being attached to said swivel arm at two different elevations in such a fashion that said replica golf ball can be pulled upwards from said swivel arm, turned 180 degrees and replaced upon the swivel arm in such a fashion that said swivel arm is inserted into said replica golf ball, the result being said replica golf ball being attached at a position which is higher or lower than the position of said replica golf ball immediately prior to removal of said replica golf ball from said swivel arm.

14. A golf swing practice simulator device comprising:

a replica golf ball;

a rigid swivel arm having an upper end and a lower ball shaped end, said replica golf being attached to said upper end;

a socket, said socket rotatably receiving said lower ball shaped end;

a housing, said socket attached to said housing;

a motion processing unit positioned at a fixed distance to said lower ball shaped end, said motion processing unit comprising:

an optical sensing unit for detecting rotational movement of said lower ball shaped end and generating a digital signal output proportional to the detected rotational movement of said lower ball shaped end;

a digital processor circuit connected with said optical sensing unit for receiving said digital signal output and for calculating the trajectory and force impact of a golf club hitting said replica golf ball;

a display monitor connected to said digital processor circuit for providing a visual display of the trajectory to a user;

said optical sensing unit comprising:

a light source, said light source directing light at said lower ball shaped end;

a semiconductor light sensor for sensing reflected light from said light source;

a digital signal processor connected to said semiconductor light sensor for generating said digital signal output;

said lower ball shaped end is finished to a roughness grade that is conducive to the reflection of light;

said housing defines a V-shaped notched for receiving and cradling said swivel arm, and wherein said V-shaped notched is flared at an angle often degrees to the vertical; and said replica golf ball is capable of being attached to said swivel arm at two different elevations.

15. The golf swing practice simulator device of claim 14, wherein said replica golf ball is capable of being attached to said swivel arm at two different elevations in such a fashion that said replica golf ball can be pulled upwards from said swivel arm, turned 180 degrees and replaced upon the swivel arm in such a fashion that said swivel arm is inserted into said replica golf ball, the result being said replica golf ball being attached at a position which is higher or lower than the position of said replica golf ball immediately prior to removal of said replica golf ball from said swivel arm.

* * * * *